United States Patent [19]

Winey

[11] 4,319,096

[45] Mar. 9, 1982

[54] LINE RADIATOR RIBBON LOUDSPEAKER

[76] Inventor: James M. Winey, 367 Carolyn La., White Bear Lake, Minn. 55120

[21] Appl. No.: 130,209

[22] Filed: Mar. 13, 1980

[51] Int. Cl.[3] ..... H04R 9/06

[52] U.S. Cl. ..... 179/115 V

[58] Field of Search ..... 179/115 V

[56] References Cited

U.S. PATENT DOCUMENTS

| | | | |
|---|---|---|---|
| 1,557,356 | 10/1925 | Gerlach | 179/115 V |
| 3,027,541 | 3/1962 | Harris | 179/115.5 PV |
| 4,001,522 | 1/1977 | Kasatkin et al. | 179/115 V |
| 4,001,523 | 1/1977 | Kasatkin et al. | 179/115 V |
| 4,027,111 | 5/1977 | Kasatkin et al. | 179/115 V |
| 4,114,532 | 9/1978 | Arzoumianian | 335/306 |
| 4,187,444 | 2/1980 | Gerard | 335/306 |

FOREIGN PATENT DOCUMENTS

| | | | |
|---|---|---|---|
| 991650 | 10/1951 | France | 179/115 V |
| 1195413 | 11/1959 | France | 179/115 V |
| 422163 | of 1947 | Italy | 179/115 V |
| 460775 | 2/1937 | United Kingdom | 179/115 V |
| 674470 | 6/1952 | United Kingdom | 179/115 V |

*Primary Examiner*—George G. Stellar

[57] ABSTRACT

An audio frequency transducer having a ribbon tweeter with a multiplicity of side-by-side elongate strip-like magnets with elongate spaces therebetween, the confronting sides of the magnets having pole faces of opposite polarity to create intense magnetic fields therebetween, signal-carrying ribbon-like conductors in the intense magnetic field between adjacent magnets vibrating to produce sound output.

17 Claims, 8 Drawing Figures

FIG. 1
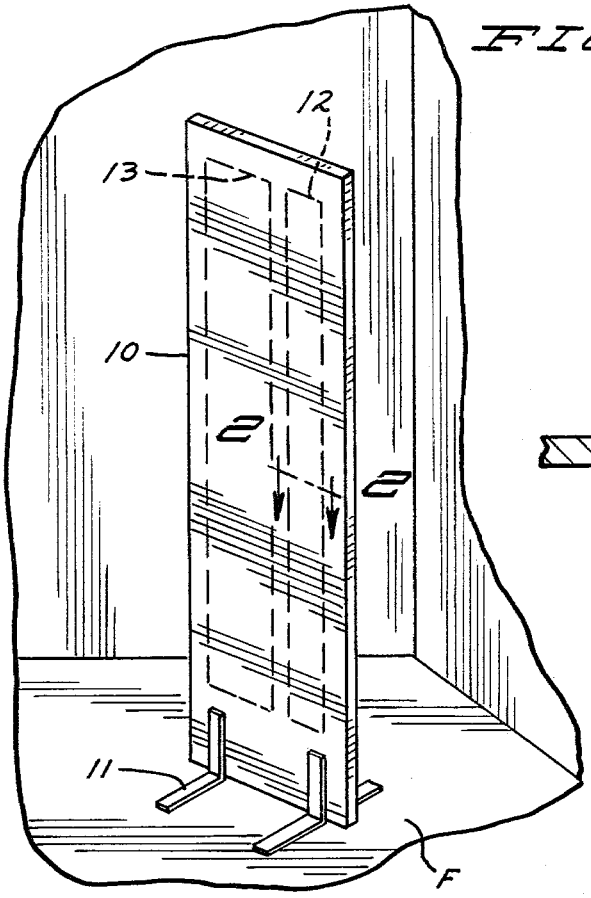
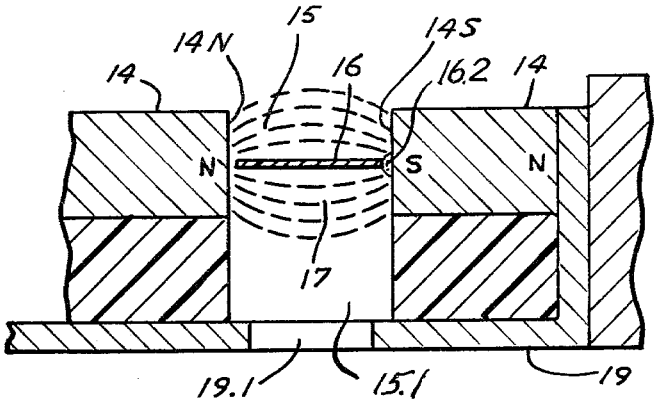
FIG. 4
FIG. 2
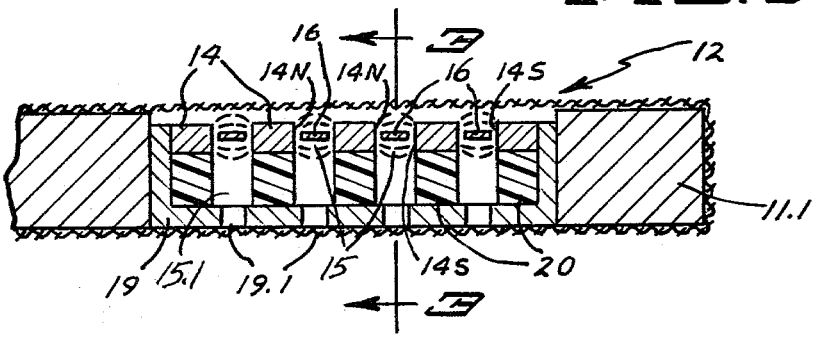
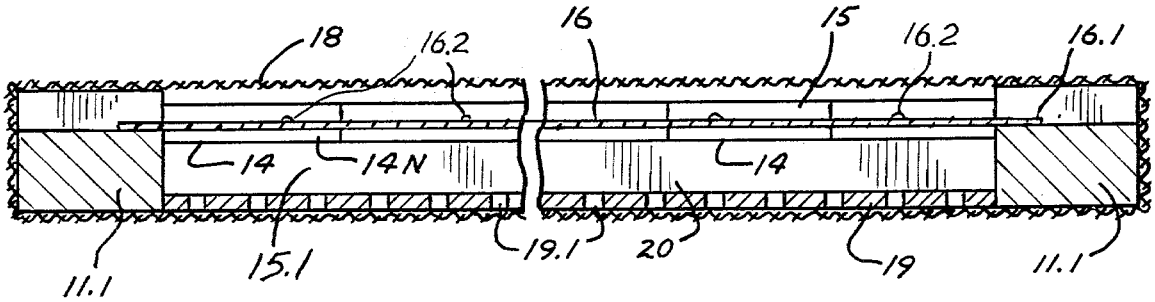
FIG. 3

LINE RADIATOR RIBBON LOUDSPEAKER

This invention relates to a ribbon tweeter.

BACKGROUND OF THE INVENTION

Transducers known as ribbon tweeters have been known in the past. They have been marginally useful for several reasons.

Such ribbon tweeters have been extremely large and bulky for the output obtained; have had objectionable beaming characteristics so that their output can be heard in only isolated locations; their impedance has been so low that expensive transformers have been required to match the transducer impedance to the amplifier impedance; and finally, only minimal output from such ribbon tweeters has been possible.

Accordingly, use of such ribbon tweeters has not proved effective, and use of such ribbon tweeters has not become widespread.

BRIEF SUMMARY OF THE INVENTION

An object of the invention is to provide an improved ribbon tweeter which takes substantially full advantage of the available magnetic fields in producing greater sound power output with the available input signal current.

A further object of the invention is to provide a novel ribbon tweeter which minimizes the effect of beaming in a vertical direction so as to make maximum sound output available to listeners at various locations relative to the transducer and to allow the listeners to move about without experiencing attenuation of the sound output.

Another object of the invention is to provide a ribbon tweeter which may be direct driven from the output stage of an amplifier.

Still another object of the invention is to provide a ribbon tweeter which may have a minimal mismatch in impedance as compared to the impedance of the output stage of an amplifier as to permit the tweeter to be driven by an inexpensive step up transformer at the output stage of the amplifier.

A feature of the invention is the construction of the ribbon tweeter type transducer with spaced parallel, elongate strip magnets polarized so that adjacent strip magnets have pole faces of opposite polarity confronting each other, and wherein said pole faces of adjacent strip magnets are separated by an elongate open space through which a conductor extends. The conductor carries the input signal current and is embraced by the magnetic field of maximum flux density. Accordingly, the conductor is vibrated with maximum intensity in the elongate space to generate intensive sound.

Another feature of this invention is the multiple sets of elongate strip magnets, in spaced side-by-side arrangement facilitating use of multiple conductors in the transducer.

Another feature of this invention is the arrangement of multiple ribbon-shaped conductors as the sound generator of the transducer.

Another feature of this invention is the capability of the transducer with the spaced, and oppositely polarized pole faces confronting each other across an elongate space, which has a magnetic field of substantially maximum density, and which may confine a conductor of round cross section like a wire, or a conductor of flat thin cross section like a ribbon. The conductor may be in several runs in each magnetic field, and in some instances may be carried on a strip type diaphragm confined wholly within the elongate space.

Still another feature of the invention is that the elongate strip magnets are laid along each other in spaced relation, and the adjacent magnets may be formed of various magnetic materials. For instance, a ceramic magnet may be laid adjacent a rare earth magnet or a samarium cobalt magnet, or barium ferrite. The magnetic field will typically have a strength of 1000 gauss to 4000 gauss depending upon the type of material in the magnet.

A principal advantage of this type of transducer is that the transducer may be directly coupled to and driven by the output stage of the amplifier, or the transducer may be so related to the amplifier that only a small mismatch exists between the impedances of the transducer and amplifier, thus making it possible to drive the transducer with an inexpensive transformer.

The advantage of this type of transducer is that the transducer is highly efficient, that is to say that a maximum of sound is produced in relation to the input signal current.

Furthermore, the transducer has low mass and therefore has extremely good transient response.

Also, the ribbon tweeter of the transducer provides the advantage of having a greatly increased length sufficient so that when the transducer is oriented in an upright position, a person's ear will be in front of it regardless of whether the person is standing up or sitting down. Accordingly, whether or not there is vertical dispersion of the sound from the ribbon tweeter of the transducer is essentially of no concern. Typically, the ribbon tweeter will oftentimes have a length in the range of three to five feet, but the length can vary considerably from that range, and may be as short as one and one-half feet or less. Although lengths longer than five feet are practical, there is not often significant need for such longer lengths.

BRIEF DESCRIPTION OF THE DRAWINGS

FIG. 1 is a perspective view of a planar type speaker in upright position.

FIG. 2 is an enlarged detail section view taken approximately at 2—2 of FIG. 1.

FIG. 3 is a detail section view taken approximately at 3—3 in FIG. 2.

FIG. 4 is a greatly enlarged detail section view of the invention.

DETAILED SPECIFICATION

Figure 5:
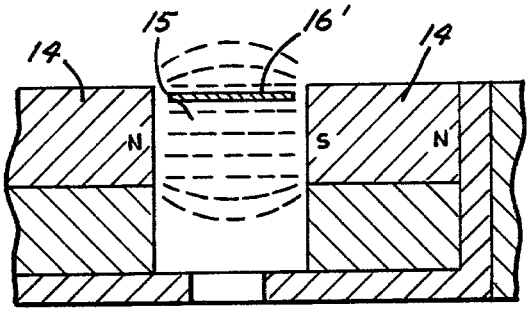
FIG. 5 is an enlarged detail section view of a modified form of the invention.

The form of the invention illustrated in FIGS. 1–4 illustrates a planar type speaker or line radiator type transducer 10 which is generally rectangular shaped from an overall standpoint and is supported on the floor by feet 11 fastened to the lower portion of the frame of the transducer. The transducer 10 has a tweeter section 12 and a mid-range base section 13. The narrow tweeter section has an overall length approximately the same as the speaker as a whole, and may be four to six feet in length, or longer.

The tweeter section of the transducer 10 includes a multiplicity of elongate strip-type magnets 14 in spaced and side-by-side relation with each other and lying substantially in a plane and defining elongate open spaces 15 therebetween.

The magnets 14 may be formed of any of a number of different magnetic materials, and may be sintered magnets, such as barium ferrite, or may be rare earth magnets, such as samarium cobalt. Although, in many cases, all of the magnets 14 will be formed of identical material, it is practical and advantageous in some instances to use magnets of different material in the transducer. For instance, alternate magnets lying side-by-side with each other may be formed of different material. As a result, certain economies may be effected, and the magnetic fields between adjacent magnets can be established as desired.

Each of the elongate spaces 15 between adjacent magnets 14 contains an elongate ribbon-like conductor 16 which extends substantially throughout the entire length of the transducer and which has a width very nearly the same as the width of the space between adjacent magnets. A typical conductor 16 is made of aluminum foil with a thickness of 0.0005 inches and approximately one-fourth inch wide; and the conductor may be either flat or corrugated. If corrugated, the corrugations may extend longitudinally or transversely of the conductor.

As clearly illustrated in FIG. 4, the adjoining magnets 14 adjacent each of the spaces 15 have magnetic pole faces 14N and 14S which have opposite magnetic polarities. As a result, an intense magnetic field 17 is established in each of the spaces 15 and embraces the conductor 16 therein. Preferably, the conductor 16 is located midway of the thickness of the space 15 so as to be symmetrically arranged therein.

However, it may be desirable under certain circumstances, as illustrated in FIG. 5, that the ribbon conductor 16' may be disposed asymmetrically in relation to the thickness of the elongate space 15 between the magnets, but, as illustrated in FIG. 5, the conductor 16' is definitely disposed within the magnetic field disposed between the opposite pole faces of the adjacent magnets 14. In some instances the conductor 16' as illustrated in FIG. 5 may be located so that its edge does not directly confront the pole face of one of the magnets, that is to say, the conductor is moved above the top surface of the two confronting magnets; and the conductor will still be disposed in the magnetic field of the two magnets.

It will be recognized that the conductors 16 are substantially free of the magnets 14 and are free to oscillate in the spaces 15 so as to produce audible sound when audio frequency input currents are applied to the conductors. The conductors 16 are secured at their opposite ends 16.1 to the frame 11.1 of the transducer.

It is desirable to attach the edges of the conductor 16, at spots located remotely from each other to the two pole faces 14S and 14N so as to control the side to side movement of the conductor 16 in the space 15. In this respect, an edge of the conductor 16 may be attached by a spot 16.2 of adhesive to the pole face 14S at one location; and then at a location one to two inches along the length of conductor 16 therefrom, the opposite edge of the conductor may be attached by a spot of adhesive to the opposite pole face 14N, so as to stagger the points of attachment between the edges of the conductor and the opposite pole faces all along the length of the conductor. The magnets 14 are usually good insulators and the attachment of the conductor to the pole faces of the magnets will have virtually no effect on the flow of signal current through the conductors.

A fabric 18 overlies the magnets and conductors in spaced relation to enclose the transducer 12.

The transducer also includes an armature 19 of magnetic material, such as soft iron, and the armature has a multiplicity of apertures or sound openings 19.1 therethrough. Armature 19 is secured to the frame 11.1 of the transducer so as to be rigid therewith.

In an alternative form the openings 19.1 may be omitted, and instead, the lower portions 15.1 of spaces 15 between the conductors 16 and the armature 19 may be substantially filled with sound absorbtive material. The effect of using the sound absorbing material instead of openings 19.1 will be minimal at high audio frequencies.

The armature 19 is rigid and serves to support the magnets 14 in stationary relation with each other and supports each of the magnets 14 on a spacer. The spacers 20 are non-magnetic material such as extruded plastic, but are affixed securely to both the armature 19 and to the magnets 14. It will be recognized in FIG. 3 that the magnets 14 may be formed of a plurality of somewhat short segments. Certain magnetic materials are only available in short lengths, but for materials that are available in long lengths, each of the magnets 14 may be provided in one piece.

In operation, audio frequency currents are supplied to the conductors 16 which lie in the intense magnetic fields 17, and the conductors 16 are thereby caused to vibrate or oscillate to produce audible sound. In this form of the invention, the conductors 16 are formed of a ribbon-like metallic foil material which has an extremely low mass and thereby provides a good transient response to the input signal current applied thereto. The efficiency of these transducers 12 is extremely good because the conductor 16 is entirely embraced in the most intense porton of the magnetic field 17 because the conductor is disposed within the elongate space between adjoining magnets. It has been found that a magnetic field of typically 1800 gauss in each of the elongate spaces 15 may be satisfactory in many transducers, but magnetic fields of significantly greater and lesser intensity will also be useful and desirable. The elongate shape of the transducer 12 in the speaker 19 minimizes the lack of dispersion of the high frequency sounds in a vertical direction. The transducer 12 is extremely useful in two foot lengths and is extremely useful in four foot lengths. Proper impedances in the range of 8 ohms are very easily achieved to avoid impedance matching problems with the amplifiers.

Figure 6:
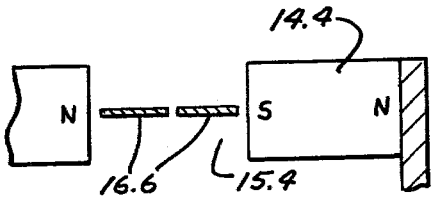
FIGS. 6, 7 and 8 are diagrammatic sketches illustrating further modified forms of the invention.

In the form illustrated in FIG. 6, two side-by-side ribbon conductors 16.6 are disposed in spaced edge-to-edge relation within the space 15.4 between the adjacent stationary magnets 14.4. These conductors may be attached at spaced locations along their edges to the faces of the magnets 14.4 so as to prevent the conductors from engaging each other and causing short circuits. Normally, the conductors 16.6 will be connected in series to raise the efficiency and also raise the impedance of the transducer as a whole. The conductors 16.6 will act together for producing the audible sound and will both carry the audio frequency input current.

Figure 7:
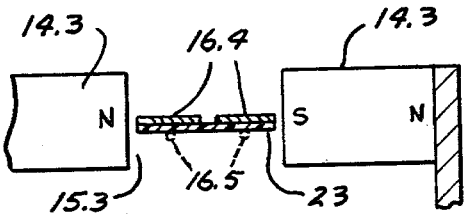

In the form of the transducer of FIG. 7, the ribbon conductors 16.4 are secured to a diaphragm 23 which lies directly in the elongate space 15.3 between the adjacent magnets 14.3. In this form, the entire diaphragm 23 vibrates with the ribbon conductors 16.4 for the purpose of producing audible sound which responds well to the signals applied. In FIG. 7, wire conductors 16.5 may be substituted for the ribbon conductors 16.4 and the wire conductors 16.5 will also be affixed to the diaphragm 23 for producing vibration thereof within the elongate space wherein the diaphragm and conductors are entirely embraced by the intense magnetic field.

Figure 8:
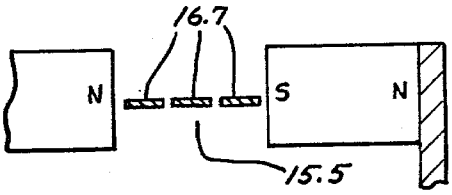

In FIG. 8, three separate ribbon conductors 16.7 are incorporated in the elongate space 15.5 wherein the conductors are entirely embraced by the intense magnetic field established between the adjacent magnets. Care must be taken in this arrangement to prevent the conductors from touching each other while vibrating. The two outside conductors may be attached at isolated locations along the length of the pole faces of the magnets and suitable precautions taken to prevent the center conductor from engaging the two outside ones. The advantages in using multiple conductors in the magnetic field are to produce a greater audio output by supplying greater current flows in the space between the magnets, and also to increase impedance.

It will be seen that the present invention provides for the signal-carrying conductor to be disposed within the most intense portion of the magnetic field between adjacent stationary magnets which have confronting opposite polarity pole faces at opposite sides of the space therebetween through which the conductor extends. Improved efficiency and impedance and extremely good transient response result from the improved transducer.

What is claimed is:

1. An elongate sound-producing strip-shaped transducer of narrow width, which is narrow enough in a transverse direction to produce wide dispersion of sound in a side to side direction and which is long enough to minimize dispersion in the other direction and to respond to an audio frequency input current, comprising a pair of elongate strip-like magnets extending longitudinally of the elongate transducer lying along and in spaced relation with each other, the magnets having strip-shaped pole faces of opposite polarity confronting each other across the width of the elongate space between adjacent magnets and thereby establishing an intense magnetic field in and adjacent the elongate space, means mounting said magnets in stationary position relative to each other, a ribbon-like conductor extending longitudinally of the elongate transducer and continuously between the ends thereof, the conductor extending along the elongate space between the strip-shaped pole faces of opposite polarity and in the magnetic field, the conductor having substantially the same length as the magnets, faces of the conductor being oriented normal to the pole faces, the conductor being free to oscillate in the space to vibrate and produce sound according to the input current applied to the conductor, and an armature of magnetic material extending the length of the transducer and traversing the magnets and the spaces therebetween and intensifying the magnetic fields in the spaces.

2. An elongate sound-producing strip-shaped transducer of narrow width which is narrow enough in a transverse direction to produce wide dispersion of sound in a side to side direction and which is long enough to minimize dispersion in the other direction and to respond to an audio frequency input current, comprising a pair of stationary elongate strip-shaped magnets of narrow width and lying along and in spaced relation with each other, the magnets having sides defining pole faces of opposite polarity confronting each other across the elongate space therebetween, whereby to establish intense magnetic fields in and adjacent the elongate space, the elongate magnets extending longitudinally of the elongate transducer and the length of the magnets being manyfold times the cumulative width of the elongate magnets and the space therebetween, a continuous ribbon-like current-carrying conductor extending longitudinally all along the elongate space in the intense magnetic field to the ends of the transducers and lying normal to the pole faces, the ribbon-like conductor having substantially the same length as the magnets, means mounting the conductor to permit oscillation of the conductor under the combined influence of the intense magnetic field and the audio frequency input current in the conductor, and an armature of magnetic material extending along the length of the magnets and transversely thereof to provide a low reluctance flux path therebetween for intensifying the magnetic fields in the spaces.

3. The transducer according to claim 2 and an armature of magnetic material engaging the magnets and intensifying the magnetic field in said space.

4. The transducer according to claim 2 and the magnets being arranged in side-by-side relation and lying substantially in a common plane, the ribbon-shaped conductor having edges confronting the pole faces.

5. The transducer according to claim 2 and said current-carrying conductor being formed of wire.

6. The transducer according to claim 2 and the elongate space having width between adjacent pole faces and having a thickness in a direction transversely of the width, the conductor being disposed within the thickness of the elongate space.

7. The transducer according to claim 6 and the conductor being disposed in the space substantially midway of the thickness of the space.

8. The transducer according to claim 6 and said conductor being disposed in said space generally asymmetrically relative to the thickness of the space.

9. The transducer according to claim 2 and the edges of the ribbon conductor being in close proximity with the pole faces whereby the ribbon conductor substantially entirely traverses the width of the elongate space.

10. The transducer according to claim 2 wherein one of said magnets of the pair of magnets being formed of one magnetic material, and the other of said magnets of the pair of magnets being formed of a different magnetic material.

11. The transducer according to claim 2 and there being a second ribbon conductor lying along the first mentioned conductor, the conductors being in substantially edge to edge relation with each other.

12. The transducer according to claim 11 and the conductors in each of the elongate spaces being secured to a diaphragm all along the length thereof.

13. The transducer according to claim 12 and the diaphragm being in the elongate space between the pole faces.

14. The transducer according to claim 2 and each of the elongate magnets including a multiplicity of elongate magnet segments lying in end-to-end relation with each other.

15. An elongate, sound producing line radiator type transducer which is narrow enough in a transverse direction to produce wide dispersion of sound in a side to side direction and which is long enough to minimize dispersion considerations in the other direction and to respond to an audio frequency input current comprising a multiplicity of stationary elongate strip-shaped magnets and a multiplicity of elongate ribbon-like current carrying conductors, the magnets and conductors extending all along each other and continuously to the ends of the transducer, the magnets lying along and in spaced relation with each other, the magnets having obverse and reverse sides confronting each other across the elongate spaces between adjacent magnets, the obverse and reverse side of the magnets adjacent each elongate space defining magnetic pole faces of opposite polarity whereby to establish intense magnetic fields in and adjacent the elongate spaces, and the ribbon-like conductors extending along the elongate spaces in the intense magnetic fields and lying normal to the pole faces, means mounting the conductors to permit oscillation of the conductors under the combined influence of the intense magnetic field and the audio frequency input current in the conductors, and an armature of magnetic material extending along the length of the magnets and traversing the magnets and the spaces therebetween and intensifying the magnetic fields in the spaces.

16. The transducer according to claim 15 and the multiplicity of magnets including a pair of outermost magnets with at least one additional magnet disposed therebetween, and an armature of magnetic material engaging both of said outermost magnets and spaced from said at least one additional magnet.

17. The transducer according to claim 16 and a non-magnetic spacer means mounting at least one additional magnet on the armature.

* * * * *